US008677523B2

(12) United States Patent
Tsukada et al.

(10) Patent No.: US 8,677,523 B2
(45) Date of Patent: Mar. 25, 2014

(54) BED AND WHEELCHAIR

(75) Inventors: Shohei Tsukada, Osaka (JP); Yohei Kume, Osaka (JP); Hideo Kawakami, Osaka (JP); Tohru Nakamura, Osaka (JP); Toshihide Ueda, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/394,408

(22) PCT Filed: Jun. 20, 2011

(86) PCT No.: PCT/JP2011/003496
§ 371 (c)(1),
(2), (4) Date: Mar. 6, 2012

(87) PCT Pub. No.: WO2011/161928
PCT Pub. Date: Dec. 29, 2011

(65) Prior Publication Data

US 2012/0159705 A1 Jun. 28, 2012

(30) Foreign Application Priority Data

Jun. 21, 2010 (JP) ..... 2010-140086

(51) Int. Cl.
*A61G 7/10* (2006.01)

(52) U.S. Cl.
USPC ..... 5/86.1; 5/2.1; 5/600; 5/617; 5/618

(58) Field of Classification Search
USPC ..... 5/2.1, 1, 81.1 R, 600, 618, 617, 86.1, 5/424, 425, 428, 613; 297/344.16, 411.3
See application file for complete search history.

(56) References Cited

U.S. PATENT DOCUMENTS 4,987,620 A * 1/1991 Sharon ..... 5/600
5,555,582 A * 9/1996 Jerideau ..... 5/600

(Continued)

FOREIGN PATENT DOCUMENTS

JP 5-51330 7/1993
JP 8-257061 10/1996

(Continued)

OTHER PUBLICATIONS

International Preliminary Report on Patentability and Written Opinion issued Jan. 24, 2013 in corresponding International (PCT) Application No. PCT/JP2011/003496.

(Continued)

*Primary Examiner* — Peter M Cuomo
*Assistant Examiner* — Brittany Wilson
(74) *Attorney, Agent, or Firm* — Wenderoth, Lind & Ponack, L.L.P.

(57) ABSTRACT

A wheelchair includes a seating bottom portion, a chair back bottom support member supporting a chair back bottom member, and a chair knee bottom support member supporting a chair knee bottom member. A chair leg first bottom support member is bendably coupled to the chair knee bottom support member. The chair leg first bottom support member supports a chair leg first bottom member, a chair leg second bottom support member is bendably coupled to the chair leg first bottom support member, and the chair leg second bottom support member supports a chair leg second bottom member. A chair base portion bendably couples the chair back bottom support member and the chair knee bottom support member and supports a chair waist bottom member, a first link portion coupling the chair back bottom support member and the chair knee bottom support member, and a second link portion coupling the chair back bottom support member and the chair leg first bottom support member to each other. The wheelchair forms a bed capable of being changed to a knee lifting posture when being combined with a bed main body portion.

8 Claims, 16 Drawing Sheets

(56) References Cited

U.S. PATENT DOCUMENTS

| | | | | |
|---|---|---|---|---|
| 6,272,702 | B1 * | 8/2001 | Uchida et al. | 5/600 |
| 6,584,629 | B2 * | 7/2003 | Tsuji et al. | 5/618 |
| 2010/0199422 | A1 * | 8/2010 | Patwardhan | 5/2.1 |

FOREIGN PATENT DOCUMENTS

| | | |
|---|---|---|
| JP | 10-52459 | 2/1998 |
| JP | 2002-58709 | 2/2002 |
| JP | 2008-131961 | 6/2008 |
| JP | 2010-253192 | 11/2010 |

OTHER PUBLICATIONS

International Search Report issued Jul. 12, 2011 in International (PCT) Application No. PCT/JP2011/003496.

* cited by examiner

9

BED AND WHEELCHAIR

TECHNICAL FIELD

The present invention relates to a bed and a wheelchair, the bed combining the wheelchair and a bed main body portion.

BACKGROUND ART

Upon nursing care of a bedridden aged person or an ailing person (hereinafter, collectively abbreviated as the care-receiver), a moving task of moving the care-receiver from a wheelchair to a bed is a heavy burden on a caregiver. Therefore, in order to reduce the burden, there is a combination bed in which part of the bed can be separated and transformed into a wheelchair (for example, refer to Patent Document 1).

FIG. 8 shows a conventional combination bed 1. A bed surface of the combination bed 1 is composed of three plates of a side bed plate 2, a center bed plate 3, and a side bed plate 4. In order to compose the bed surface, there is a need for moving the center bed plate 3 of a platform truck 5 to a space 3*a* between the side bed plate 2 and the side bed plate 4. Firstly, the caregiver brings up the side bed plate 4 to the upper side of a bed main body 1*a* taking a rotation mechanism 1*b* as a rotation center.

The caregiver moves the platform truck 5 (the center bed plate 3) to the space 3*a* in a state where the side bed plate 4 is brought up to the upper side of the bed main body 1*a*. By returning the side bed plate 4 to an original position after moving the platform truck 5 to the space 3*a*, the combination bed 1 composes the bed surface.

The platform truck 5 separated from the combination bed 1 can also be utilized as a wheelchair. In that case, the center bed plate 3 serves as a seating bottom of the wheelchair.

FIG. 9 is a side view of the platform truck 5. Here, the platform truck 5 has a chair posture change mechanism in order to simply change a posture of the center bed plate 3 from a flat posture to a seating posture. The center bed plate 3 is composed of a back surface portion 3*b*, a leg portion 3*c*, and a bottom portion 3*d*. When the leg portion 3*c* is inclined in conjunction with inclination of the back surface portion 3*b* in a state where the bottom portion 3*d* is made to be a horizontal surface with use of the chair posture change mechanism, the posture of the center bed plate 3 is changed from the flat posture to the seating posture. The platform truck 5 can be utilized as the wheelchair.

In such a wheelchair (the platform truck 5) serving as a part of the combination bed 1, the bottom portion 3*d* is made to be a horizontal surface so as to change the posture to the flat posture. However, when the bottom portion 3*d* of the wheelchair is a horizontal surface, downward slippage of a body of the care-receiver is easily caused.

As a countermeasure against the downward slippage of the body of the care-receiver from the wheelchair, a fully-reclining type wheelchair in which a bottom portion of the wheelchair is inclined so as to prevent the downward slippage of the body of the care-receiver is proposed (for example, refer to Patent Document 2).

FIG. 10 is a perspective view of a conventional fully-reclining type wheelchair 6. In the wheelchair 6 shown in FIG. 10, a bottom portion 7*b* is inclined in such a manner that front seating height (height of the bottom portion 7*b* on the side of a calf portion 7*c*) is higher than rear seating height (height of the bottom portion 7*b* on the side of a back portion 7*a*). By the inclination of the bottom portion 7*b*, the downward slippage of the body of the care-receiver is prevented. Further, the back portion 7*a* is brought down, and all of the bottom portion 7*b*, the calf portion 7*c*, and a footrest portion 7*d* that are coupled by a conjunction link 8 are made to be an identical horizontal surface, so that the posture is changed to the flat posture.

FIG. 11 is a side view of the wheelchair 6 in the flat posture. By utilizing the conjunction link 8, the caregiver can easily change the posture of the wheelchair 6 from the seating posture to the flat posture.

It is considered that a bed is composed of combining such a fully-reclining type wheelchair 6 with a bed main body portion.

As a nursing care bed for providing nursing care to the care-receiver, there is a bed capable of being changed to a back lifting posture or a knee lifting posture.

CITATION LIST

Patent Literatures

[Patent Literature 1] Japanese Unexamined Utility Model Publication No. 5-51330

[Patent Literature 2] Japanese Unexamined Patent Publication No. 10-52459

SUMMARY OF THE INVENTION

Technical Problem

A nursing care bed requires a function of changing a posture to the back lifting posture for a task of having meals of the care-receiver or the like, and a function of changing the posture to the knee lifting posture for removing swelling of legs of the care-receiver or preventing the downward slippage of the body. However, in the conventional wheelchairs, there is no structure for changing the posture to the knee lifting posture. Therefore, the combination bed in which the wheelchair is combined with the bed main body portion cannot be changed to the knee lifting posture. That is, for example, in the case where the wheelchair 6 having a structure of a conventional fully-reclining type wheelchair serves as a part of the combination bed, there is a problem that the combination bed cannot be changed to the knee lifting posture. It should be noted that the knee lifting posture indicates a posture in which buttocks of the care-receiver are supported by a horizontal surface, thighs and calves are supported by an inclined surface, and a hip joint, a knee joint, and a toe form a triangle.

The present invention is to solve such a problem, and an object thereof is to provide a bed and a wheelchair capable of being changed to the knee lifting posture in a bed state and capable of preventing the downward slippage of the body of the care-receiver in a wheelchair state.

Solution to the Problem

In order to achieve the above object, the present invention is formed as below.

According to one aspect of the present invention, there is provided a bed having a bed surface composed of combining a wheelchair and a bed main body portion, the wheelchair comprising:

a seating bottom portion composed of bendably coupling a chair back bottom member, a chair waist bottom member, a chair knee bottom member, and a chair leg bottom member to each other;

a chair back bottom support member supporting the chair back bottom member, a chair base portion supporting the chair waist bottom member, a chair knee bottom support member supporting the chair knee bottom member, and a chair leg bottom support member supporting the chair leg bottom member, the bed main body portion comprising:

a bed bottom portion composed of bendably coupling a bed back bottom member, a bed waist bottom member, a bed knee bottom member, and a bed leg bottom member to each other, a bed back bottom support member supporting the bed back bottom member, a bed base portion supporting the bed waist bottom member, a bed knee bottom support member supporting the bed knee bottom member, and a bed leg bottom support member supporting the bed leg bottom member, and in a state where the wheelchair and the bed main body portion are combined, a joint portion between the bed back bottom member and the bed waist bottom member and a joint portion between the chair back bottom member and the chair waist bottom member are arranged on an identical straight line, a joint portion between the bed waist bottom member and the bed knee bottom member and a joint portion between the chair waist bottom member and the chair knee bottom member are arranged on an identical straight line, and a joint portion between the bed knee bottom member and the bed leg bottom member and a joint portion between the chair knee bottom member and the chair leg bottom member are arranged on an identical straight line.

According to another aspect of the present invention, there is provided a wheelchair capable of being combined with a bed main body portion so as to compose a bed, including:

a seating bottom portion composed of bendably coupling a chair back bottom member, a chair seating bottom member including a chair waist bottom member and a chair knee bottom member, a chair leg first bottom member, and a chair leg second bottom member to each other;

a chair base portion supporting the chair waist bottom member;

a chair back bottom support member bendably arranged to the chair waist bottom member, the chair back bottom support member supporting the chair back bottom member;

a chair knee bottom support member bendably arranged to the chair waist bottom member, the chair knee bottom support member supporting the chair knee bottom member;

a chair leg first bottom support member bendably arranged to the chair knee bottom support member, the chair leg first bottom support member supporting the chair leg first bottom member;

a chair leg second bottom support member bendably arranged to the chair leg first bottom support member, the chair leg second bottom support member supporting the chair leg second bottom member;

a first link portion that moves the chair knee bottom support member in conjunction with movement of the chair back bottom support member;

a second link portion that moves the chair leg first bottom support member in conjunction with the movement of the chair back bottom support member; and a footrest conjunction link that moves the chair leg second bottom support member in conjunction with movement of the chair knee bottom support member.

Advantageous Effects of the Invention

The bed of the present invention can be changed to a knee lifting posture in a bed state in which the wheelchair and the bed main body portion are combined. In a wheelchair state, downward slippage of a body of a care-receiver can be prevented.

BRIEF DESCRIPTION OF THE DRAWINGS

These and other aspects and features of the present invention will become clear from the following description taken in conjunction with the preferred embodiments thereof and with reference to the accompanying drawings, in which.

DESCRIPTION OF THE PREFERRED EMBODIMENTS

Figure 1:
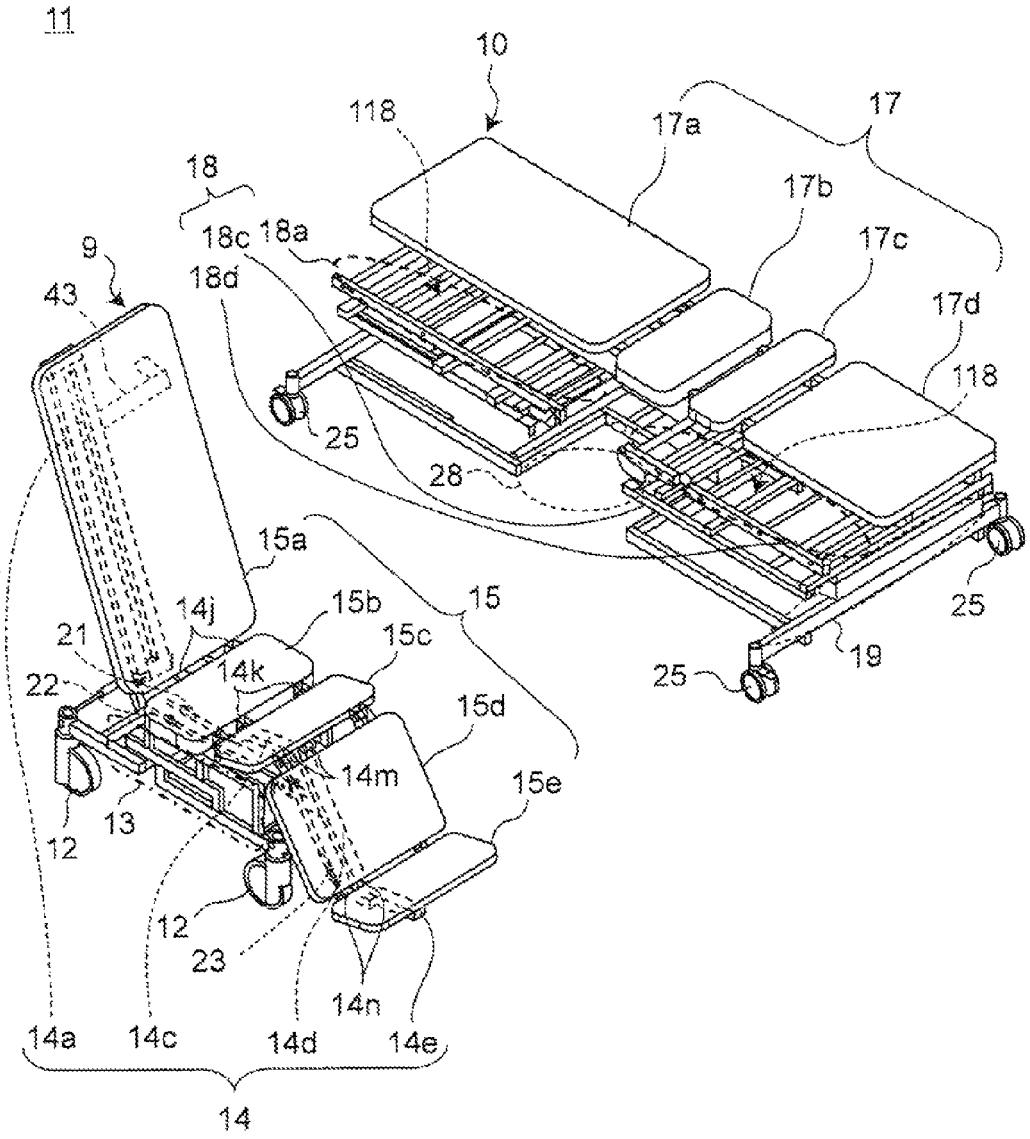
FIG. 1 is a perspective view of a separated bed in one embodiment of the present invention.

Before the description of the present invention proceeds, it is to be noted that like parts are designated by like reference numerals throughout the accompanying drawings.

Hereinafter, an embodiment of the present invention will be described with reference to the drawings. It should be noted that the same constituent elements will be given the same reference numerals, and description thereof will sometimes be omitted. For easy understanding, the figures are schematic focusing on the constituent elements.

FIG. 1 is a perspective view of a separated bed in one embodiment of the present invention. A bed 11 is composed of a wheelchair 9 and a bed main body portion 10.

Firstly, the wheelchair 9 is composed of a seating bottom portion 15, a chair support member (chair guide member) 14, a chair base portion 13, and traveling wheels 12.

The chair support member 14 is composed of a plurality of chair support members 14*a*, 14*c*, 14*d*, 14*e*, and chair bending portions 14*j*, 14*k*, 14*m*, 14*n*.

The seating bottom portion 15 is composed of bendably coupling a plurality of plate shape chair bottom members (such as five chair bottom members 15*a*, 15*b*, 15*c*, 15*d*, 15*e*) at coupling parts (joint portions 20*b*, 20*d*, 20*f*, 20*g* described later). The plurality of chair bottom members serve as parts to be respectively brought into contact with a body of a patient, a care-receiver, or the like (hereinafter, collectively abbreviated as the care-receiver).

The seating bottom portion 15 is composed of the chair back bottom member 15*a*, the chair waist bottom member 15*b*, the chair knee bottom member 15*c*, and the chair leg bottom member (the chair leg first bottom member 15*d* and the chair leg second bottom member 15*e*). Among these members, the adjacent members are bendably coupled to each other via the coupling parts of thin parts or hinge parts. The coupling parts of the thin parts may be composed of parts each having a thickness thinner than a thickness of each of the chair back bottom member 15*a* to the chair leg second bottom member 15*e* which mainly compose the seating bottom portion 15, and thereby the coupling parts are bendable. The chair back bottom member 15*a* is a part to be brought into contact with a back of the care-receiver. The chair waist bottom member 15*b* is a part to be brought into contact with a waist of the care-receiver. The chair knee bottom member 15*c* is a part to be brought into contact with thighs of the care-receiver. The chair leg first bottom member 15*d* is a part to be brought into contact with legs of the care-receiver. The chair leg second bottom member 15*e* is a part to be brought into contact with heels of the care-receiver. These members generally have a cushion function. It should be noted that the chair leg second bottom member 15*e* serves as a footrest of the care-receiver when the wheelchair 9 is in a seating posture (in a wheelchair state).

It should be noted that the chair waist bottom member 15*b* and the chair knee bottom member 15*c* compose a chair seating bottom member 15*h*.

The plurality of chair support members 14*a*, 14*c*, 14*d*, 14*e* and the chair waist bottom member 15*b* are bendably coupled to one another via the chair bending portions 14*j*, 14*k*, 14*m*, 14*n*, respectively, composed of free rotation joints so as to compose a chair posture change mechanism 114. The chair posture change mechanism 114 changes a posture of the seating bottom portion 15.

The chair base portion 13 supports the chair waist bottom member 15*b* to which the chair support member 14 is coupled while allowing a bending action of the chair support member 14, and has the four traveling wheels 12 in a lower part. The wheelchair 9 is moved by these four traveling wheels 12. In the present embodiment, there is no power in the wheelchair 9 but the wheelchair is moved by hand. The wheelchair 9 is moved when a nurse, a caregiver, or the like (hereinafter, collectively abbreviated as the caregiver) pushes a handle 43 provided in the chair support member 14.

At least a pair of traveling wheels 12 is provided, and in the present embodiment, two pairs of traveling wheels (four traveling wheels) are rotatably provided in the lower part of the chair base portion 13 so as to movably support the chair base portion 13. The traveling wheels 12 are capable of traveling on a ground (or an installment surface of the wheelchair 9 and the bed main body portion 10) 44.

The wheelchair 9 is so constructed that, when posture change is performed by the posture change mechanism 114, the posture of the seating bottom portion 15 may be changed in accordance with the posture change of the chair support member 14. In the present embodiment, the plate shaped chair bottom members 15*a*, 15*b*, 15*c*, 15*d*, 15*e* composing the seating bottom portion 15 of the wheelchair 9 are freely bent at the coupling parts. Thus, the seating bottom portion 15 cannot maintain a fixed posture. The seating bottom portion 15 is supported by the chair support member 14 of the wheelchair 9. That is, in the present embodiment, the seating bottom portion 15 performs posture maintenance or the posture change in conjunction with a posture of the chair support member 14.

Figure 3A:
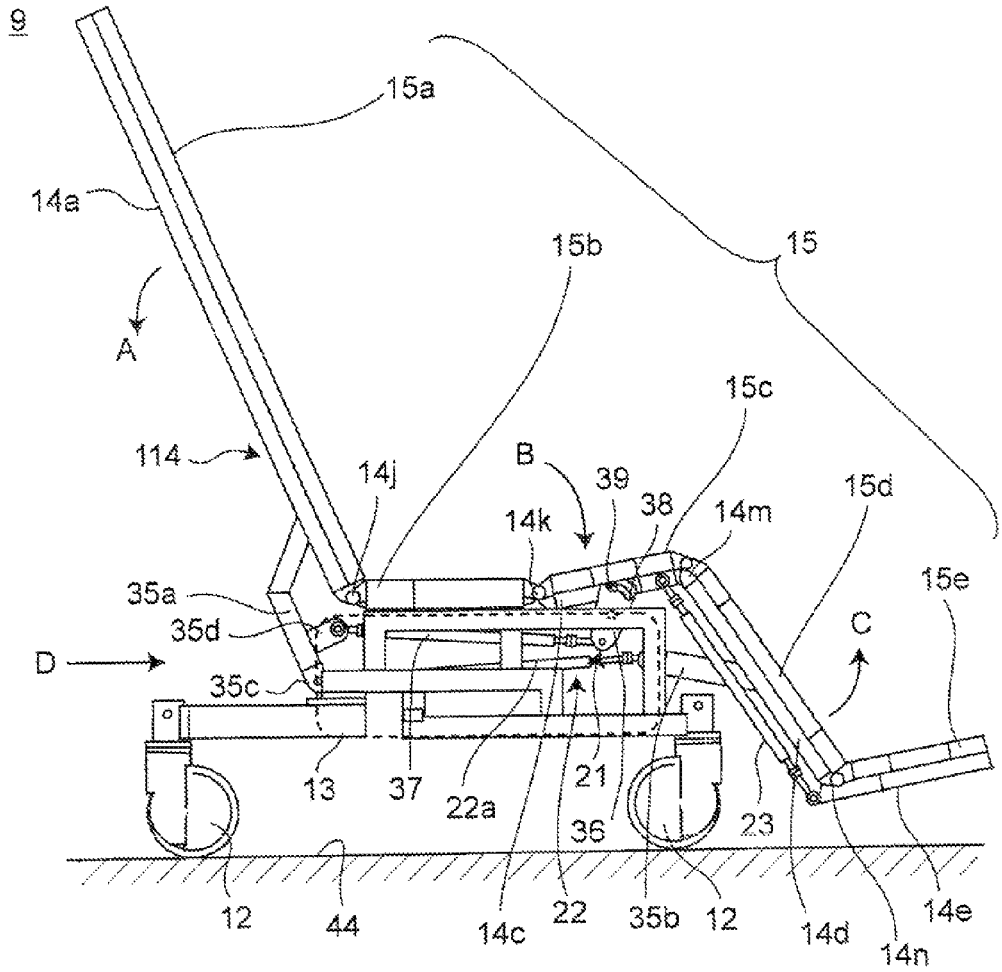
FIG. 3A is a side view of a wheelchair in a seating posture in the present embodiment.
Figure 3B:
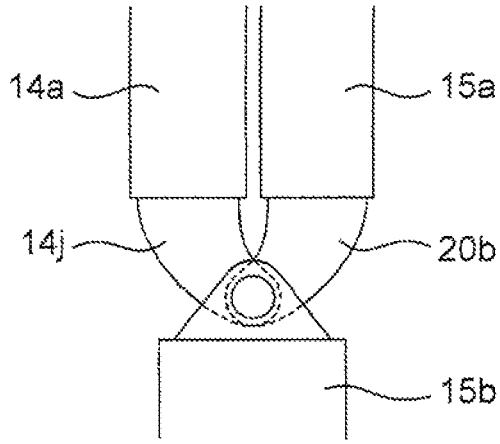
FIG. 3B is an enlarged view of the vicinity of a chair first bending portion of the wheelchair in the seating posture of FIG. 3A in the present embodiment.
Figure 3C:
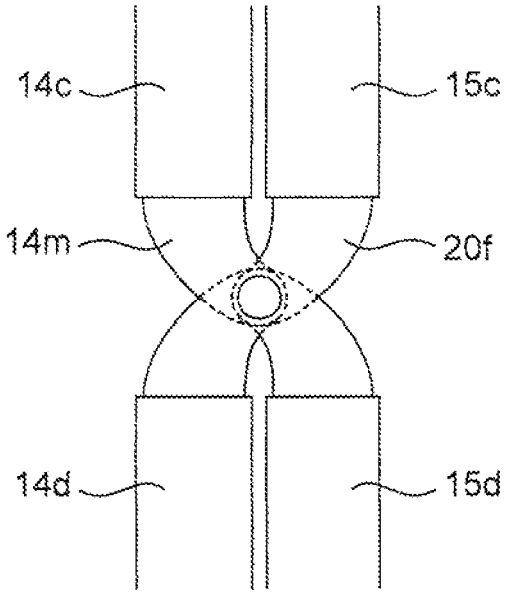
FIG. 3C is an enlarged view of the vicinity of a chair third bending portion of the wheelchair in the seating posture of FIG. 3A in the present embodiment.

As shown in FIGS. 3A to 3C, the chair support member 14 is composed of the square frame shape chair back bottom support member (chair back guide member) 14*a*, the square frame shape chair knee bottom support member (chair knee guide member) 14*c*, the square frame shape chair leg first bottom support member (chair leg first guide member) 14*d*, the square frame shape chair leg second bottom support member (chair leg second guide member) 14*e*, and the chair first to fourth bending portions 14*j*, 14*k*, 14*m*, 14*n*. The chair leg first bottom support member 14*d* and the chair leg second bottom support member 14*e* compose a chair leg bottom support member. The four chair first to fourth bending portions 14*j*, 14*k*, 14*m*, 14*n* each couple bendably the adjacent chair support members to each other or couple the chair support member and the chair waist bottom member to each other.

FIGS. 3B and 3C show enlarged views of the coupling portions.

As shown in the enlarged view of FIG. 3B, the chair back bottom member 15*a* and the chair waist bottom member 15*b* are coupled to each other by the joint portions 20*b* via a first rotation shaft, and the chair back bottom support member 14*a* and the chair waist bottom member 15*b* are coupled to each other by the chair first bending portion 14*j* via the same first rotation shaft. Although not shown, the chair waist bottom member 15*b* and the chair knee bottom member 15*c* are coupled to each other by the joint portions 20*d* via a second rotation shaft, and the chair waist bottom member 15*b* and the chair knee bottom support member 14*c* are coupled to each other by the chair second bending portion 14*k* via the same second rotation shaft.

As shown in the enlarged view of FIG. 3C, the chair knee bottom member 15*c* and the chair leg first bottom member 15*d* are coupled to each other by the joint portions 20*f* via a third rotation shaft, and the chair knee bottom support member 14*c* and the chair leg first bottom support member 14*d* are coupled to each other by the chair third bending portion 14*m* via the same third rotation shaft. Although not shown, the chair leg first bottom member 15*d* and the chair leg second bottom member 15*e* are coupled to each other by the joint portions 20*g* via a fourth rotation shaft, and the chair leg first bottom support member 14*d* and the chair leg second bottom support member 14*e* are coupled to each other by the chair fourth bending portion 14*n* via the same fourth rotation shaft.

The chair back bottom support member (chair back guide member) 14*a* is capable of supporting the chair back bottom member 15*a*. The chair base portion 13 supports the chair waist bottom member 15*b*. The chair knee bottom support member (chair knee guide member) 14*c* is capable of supporting the chair knee bottom member 15*c*. The chair leg first bottom support member (chair leg first guide member) 14*d* is capable of supporting the chair leg first bottom member 15*d*. The chair leg second bottom support member 14*e* is capable of supporting the chair leg second bottom member 15*e*. The chair back bottom support member 14*a* and the chair waist bottom member 15*b* are bendably coupled to each other by the chair first bending portion 14*j*. The chair waist bottom member 15*b* and the chair knee bottom support member 14*c* are bendably coupled to each other by the chair second bending portion 14*k*. The chair knee bottom support member 14*c* and the chair leg first bottom support member 14*d* are bendably coupled to each other by the chair third bending portion 14*m*. The chair leg first bottom support member 14*d* and the chair leg second bottom support member 14*e* are bendably coupled to each other by the chair fourth bending portion 14*n*. The handle 43 is fixed to a front end on the back surface side of the chair back bottom support member 14*a*.

Since the chair waist bottom member 15*b*, the chair back bottom support member 14*a*, and the chair knee bottom support member 14*c* are coupled to one another, position displacement is not generated between the chair bottom member 15 and the chair support member 14.

Figure 4:
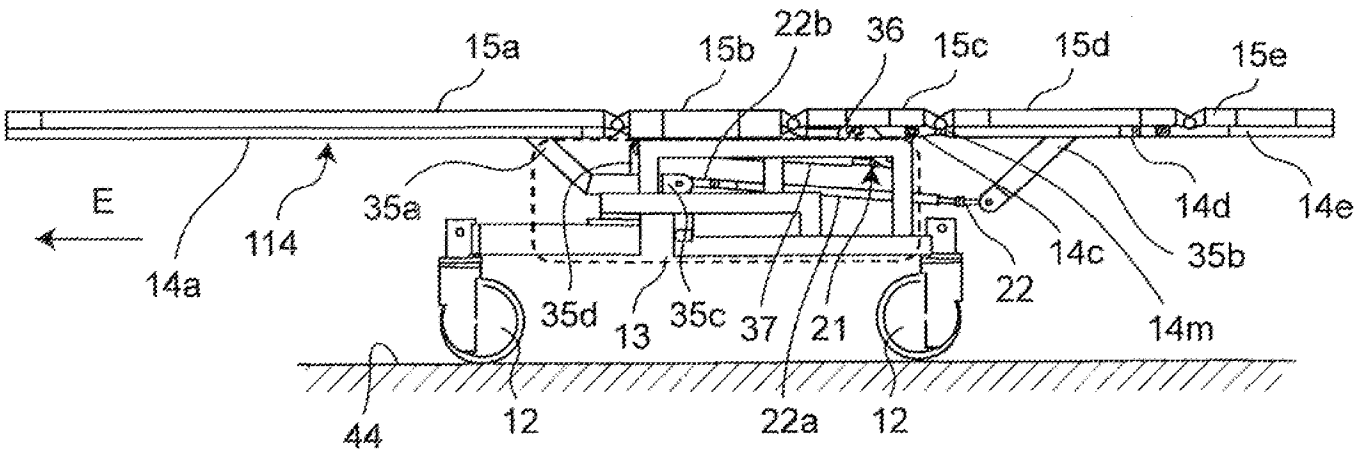
FIG. 4 is a side view of the wheelchair in a flat posture in the present embodiment.

In a flat posture shown in FIG. 4, the chair back bottom member 15*a*, the chair waist bottom member 15*b*, the chair knee bottom member 15*c*, the chair leg first bottom member 15*d*, and the chair leg second bottom member 15*e* compose one flat surface substantially along the horizontal direction. In other words, the chair back bottom support member 14*a*, the chair knee bottom support member 14*c*, the chair leg first bottom support member 14*d*, and the chair leg second bottom support member 14*e* compose one flat surface substantially along the horizontal direction.

In the seating posture shown in FIG. 3A, the chair back bottom member 15*a* and the chair back bottom support member 14*a* stand up obliquely in such a manner that these upper ends in the vertical direction are positioned on the rear side (the left side in FIG. 3A) of lower ends. The chair waist bottom member 15*b* is positioned substantially along the horizontal direction. The chair knee bottom member 15*c* and the chair knee bottom support member 14*c* are positioned slightly obliquely in such a manner that ends on the side of the chair waist bottom member 15*b* are positioned on the lower side of ends on the side of the chair leg first bottom member 15*d*. The chair leg first bottom member 15*d* and the chair leg first bottom support member 14*d* are positioned obliquely downward from ends on the side of the chair knee bottom member 15*c* to ends on the side of the chair leg second bottom member 15*e*. The chair leg second bottom member 15*e* and the chair leg second bottom support member 14*e* are positioned substantially in the horizontal direction or slightly obliquely upward from ends on the side of the chair leg first bottom member 15*d* to a front end of the chair leg second bottom member 15*e*.

Further, the wheelchair 9 has a link portion (a first link portion 21, a second link portion 22, and a footrest conjunction link 23) in such a manner that the chair support members 14*c*, 14*d*, 14*e* are moved in conjunction with movement of the chair back bottom support member 14*a*.

Figure 5A:
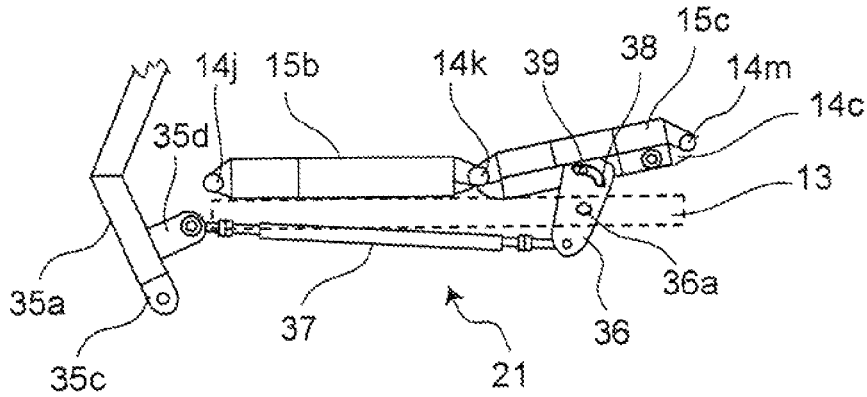
FIG. 5A is a partial side view of a first link portion in the seating posture of the wheelchair in the present embodiment.
Figure 5B:
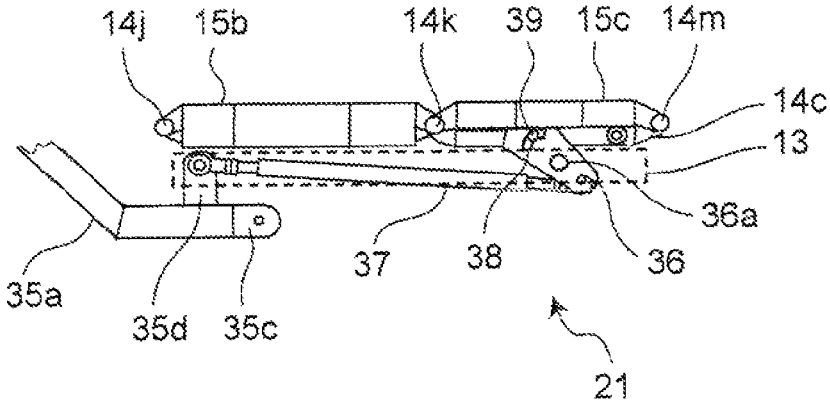
FIG. 5B is a partial side view of the first link portion in the flat posture of the wheelchair in the present embodiment.
Figure 5C:
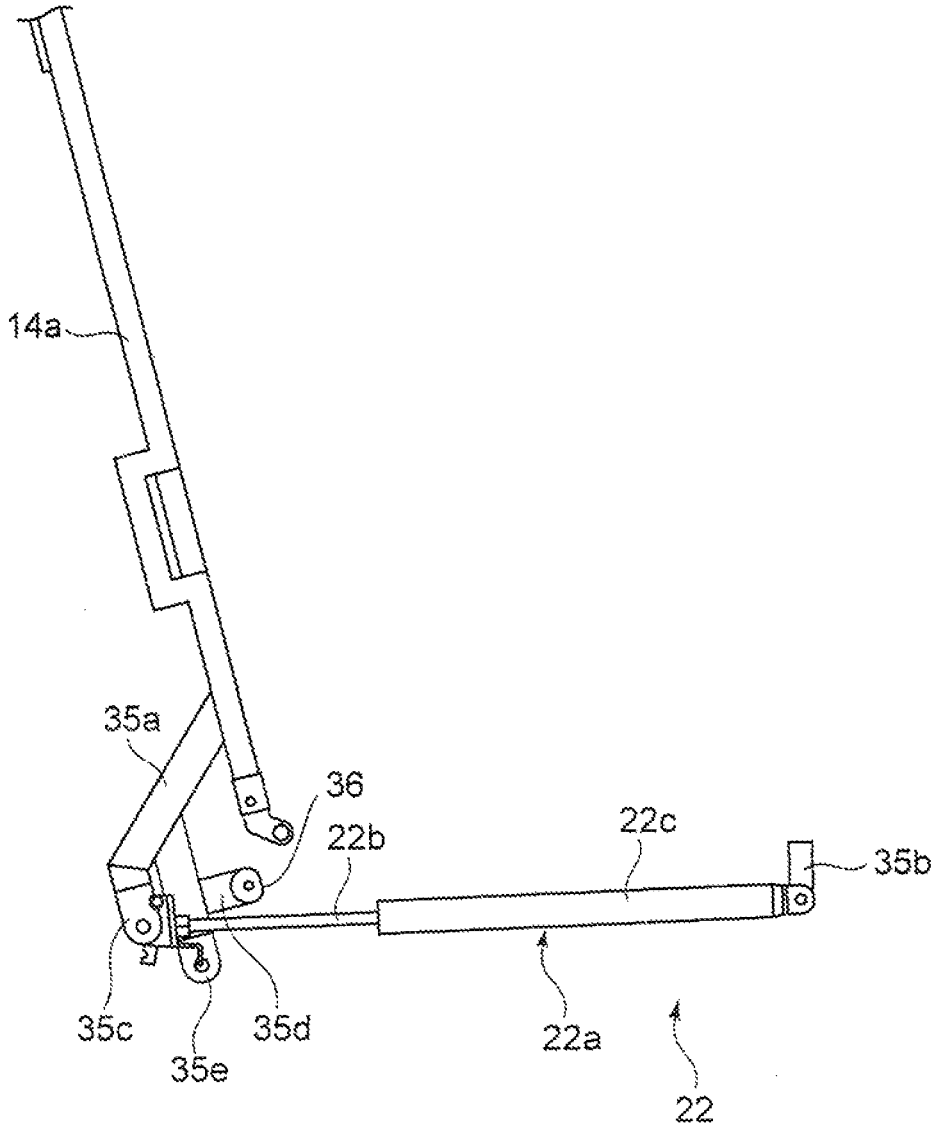
FIG. 5C is a partial side view of the vicinity of a gas spring in the seating posture of the wheelchair in the present embodiment.
Figure 5D:
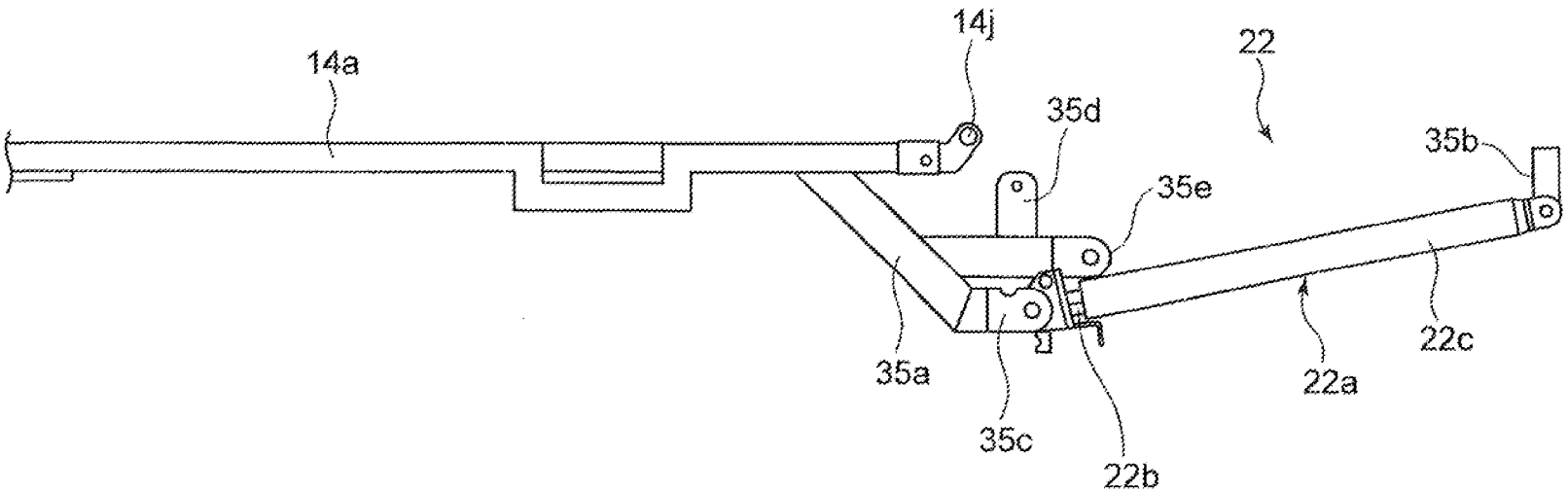
FIG. 5D is a partial side view of the vicinity of the gas spring in the flat posture of the wheelchair in the present embodiment.
Figure 5E:
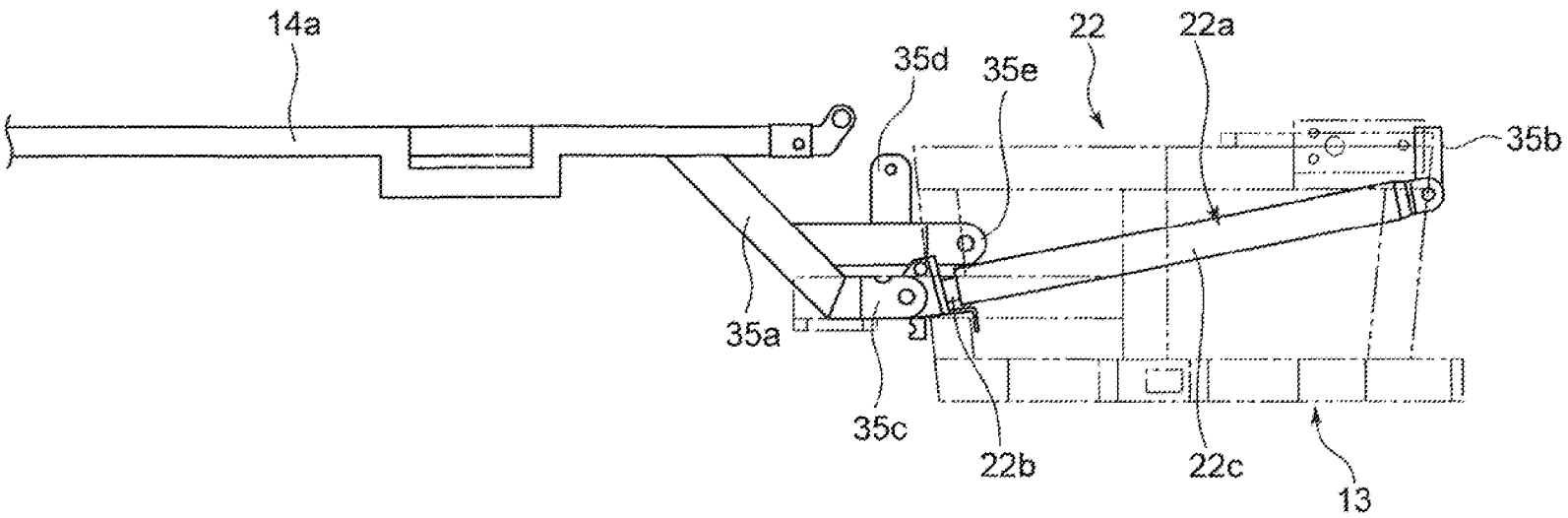
FIG. 5E is a partial side view showing a state where the gas spring is attached to a chair base portion of the wheelchair in the present embodiment.

FIGS. 5A to 5E are partial side views of the wheelchair 9. FIGS. 5A and 5B are partial side views of the first link portion 21 in the seating posture and in the flat posture. FIGS. 5C and 5D are partial side views of a gas spring 22*a* in the seating posture and in the flat posture. FIG. 5E is a partial side view showing a state where the gas spring 22*a* is attached to the chair base portion 13.

With use of FIGS. 5A to 5E, a mechanism in which the chair knee bottom support member 14*c*, the chair leg first bottom support member 14*d*, and the chair leg second bottom support member 14*e* are moved in conjunction with the movement of the chair back bottom support member 14*a* will be described.

The first link portion 21 couples the chair back bottom support member 14*a* and the chair knee bottom support member 14*c* to each other. When the chair back bottom support member 14*a* is lifted from a brought-down state (changed from the flat posture to the seating posture), the chair knee bottom support member 14*c* is lifted via the first link portion 21. Meanwhile, when the chair back bottom support member 14*a* is brought down from a lifted state (changed from the seating posture to the flat posture), the chair knee bottom support member 14*c* is brought down via the first link portion 21.

Hereinafter, further description will be given. The first link portion 21 is composed of a cam portion 36 and a coupling member 37. As shown in FIGS. 3A to 5B, a back side arm member 35*a* is coupled to the chair back bottom support member 14*a*. The back side arm member 35*a* is bent and extends from the vicinity of an end on the coupling portion side of the chair waist bottom member 15*b* and the chair back bottom support member 14*a* to the back surface side. The back side arm member 35*a* further has a front end 35*e* branched from a front end 35*c* thereof, and a branch portion 35*d* branched from the front end 35*e*. The cam portion 36 is a plate member, and a lower end thereof is coupled to the branch portion 35*d* of the back side arm member 35*a* via the rod shape coupling member 37. The cam portion 36 has a center part coupled to the chair base portion 13 rotatably on a cam portion rotation shaft 36*a*, and a semi-arc shape or recessed shape groove portion 38 into which a guide shaft 39 protrudingly fixed to the chair knee bottom support member 14*c* is inserted, in an upper end thereof. By inserting the guide shaft 39 of the chair knee bottom support member 14*c* into this groove portion 38, the cam portion 36 and the chair knee bottom support member 14*c* are coupled to each other.

Therefore, in FIG. 4, when the chair back bottom support member 14*a* is changed from the flat posture to the seating posture (the wheelchair 9 is brought from a state of FIG. 5B to a state of FIG. 5A), the back side arm member 35*a* is pivoted clockwise about the chair first bending portion 14*j*, so that the back side arm member 35*a* pulls the coupling member 37. Then, the cam portion 36 is pivoted clockwise about the cam portion rotation shaft 36*a* via the coupling member 37, the guide shaft 39 is moved in the groove portion 38, and a front end edge of the chair knee bottom support member 14*c* stands up relative to a rear end edge. As a result, at the time of the seating posture (in the wheelchair state), front seating height of the chair waist bottom member 15*b* can be higher than rear seating height. Therefore, downward slippage of the care-receiver seated on the wheelchair 9 can be prevented.

Meanwhile, in FIG. 3A, when the chair back bottom support member 14*a* is changed from the seating posture to the flat posture (the wheelchair 9 is brought from the state of FIG. 5A to the state of FIG. 5B), the back side arm member 35*a* is pivoted anticlockwise about the chair first bending portion 14*j*, so that the back side arm member 35*a* pushes out the coupling member 37. Thereby, the cam portion 36 is pivoted anticlockwise about the cam portion rotation shaft 36*a* via the coupling member 37, the guide shaft 39 is moved in the groove portion 38, and the chair knee bottom support member 14*c* is brought down into a flat state along a horizontal surface.

It should be noted that by adjusting a shape of the groove portion 38 in the cam portion 36, when the chair back bottom support member 14*a* is lifted, an angle of the chair knee bottom support member 14*c* can be adjusted.

The second link portion 22 couples the chair back bottom support member 14*a* and the chair leg first bottom support member 14*d*. When the chair back bottom support member 14*a* stands up, the chair leg first bottom support member 14*d* is suspended down via the second link portion 22. Meanwhile, when the chair back bottom support member 14*a* is brought down, the suspended-down chair leg first bottom support member 14*d* is brought up via the second link portion 22. The second link portion 22 is composed of the back side arm member 35*a*, a leg side arm member 35*b*, and a coupling member coupled to the front end 35*e*.

Hereinafter, a chair support member biasing portion will be described. Here, the gas spring 22*a* is used as one example of the chair support member biasing portion. However, instead of the gas spring 22*a*, a translation actuator can be used. A hand lever (not shown) for actuating the gas spring 22*a* is attached to the chair back bottom support member 14*a* beside the handle 43 (refer to FIG. 7A), and the hand lever and the gas spring 22*a* are coupled to each other by a wire. A piston rod 22*b* of the gas spring 22*a* is coupled to the front end 35*c* of the back side arm member 35*a* of the chair back bottom support member 14*a*. As shown in FIGS. 3A and 4, the leg side arm member 35*b* is bent and extends on a back surface of an intermediate part of the chair leg first bottom support member 14*d*, and the piston rod 22*b* is rotatably coupled to the front end 35*c* of the back side arm member 35*a*.

The gas spring 22*a* acts as follows. When the caregiver grips the hand lever beside the handle 43, a bias force of the gas spring 22*a* is imposed on the chair back bottom support member 14*a*, so that a protruding amount (length) of the piston rod 22*b* of the gas spring 22*a* can be easily changed. When the caregiver releases the hand from the hand lever beside the handle 43, the piston rod 22*b* of the gas spring 22*a* is locked with the protruding amount (length) of that time, and the posture is maintained.

Therefore, for example, when the chair back bottom support member 14*a* is lifted from a flat posture state as shown in FIGS. 4 and 5D to a seating posture state as shown in FIGS. 3A and 5C, and when the caregiver grips the hand lever for actuating the gas spring 22*a*, lock of the piston rod 22*b* of the gas spring 22*a* is cancelled, so that the bias force of the gas spring 22*a* can be imposed on the chair back bottom support member 14*a*. Even when the care-receiver is on the wheelchair 9 and the back of the care-receiver is supported by the chair back bottom member 15*a* and the chair back bottom support member 14*a*, the bias force of the gas spring 22*a* and a weight of the care-receiver are substantially cancelled out. Therefore, the caregiver can easily change the posture of the chair back bottom support member 14*a* from the flat posture along the horizontal direction to the standing seating posture. It should be noted that strength of the bias force of the gas spring 22*a* is preferably preliminarily adjusted so as to be cancelled out with the weight of the care-receiver. By imposing the bias force of the gas spring 22*a* on the chair back bottom support member 14*a* in such a way, the piston rod 22*b* of the gas spring 22*a* comes into a cylinder 22*c*, and the chair back bottom support member 14*a* can be easily pivoted clockwise of FIGS. 4 and 5D about the chair first bending portion 14*j* between the chair back bottom support member 14*a* and the chair waist bottom member 15*b* from the flat posture to the seating posture. In accordance with the pivoting action, the back side arm member 35*a* is pivoted clockwise about the chair first bending portion 14*j*, a front end of the chair leg first bottom support member 14*d* is pivoted clockwise relative to a rear end thereof via the gas spring 22*a*, and the chair leg first bottom support member 14*d* is inclined obliquely downward toward the front side and suspended down by the rotation shaft of the chair third bending portion 14*m*.

Meanwhile, when the chair back bottom support member is brought down from the seating posture as shown in FIGS. 3A and 5C to a state where the chair back bottom support member 14*a* is brought down as shown in FIGS. 4 and 5D (the flat posture), and when the caregiver grips the handle 43 with one hand while gripping the hand lever with the other hand, the lock of the piston rod 22*b* of the gas spring 22*a* is cancelled, so that the bias force of the gas spring 22*a* can be imposed on the chair back bottom support member 14*a*. At this time, by utilizing the weight of the care-receiver, the chair back bottom support member 14*a* is manually brought downward. That is, the chair back bottom support member 14*a* can be easily and slowly pivoted clockwise of FIG. 3A about the chair first bending portion 14*j*. Then, the chair knee bottom support member 14*c* and the chair leg first bottom support member 14*d* are respectively changed from an obliquely inclined posture to the flat posture along the horizontal direction. This posture change is performed by relatively pivoting about the chair second bending portion 14*k*, the chair third bending portion 14*m*, and the chair fourth bending portion 14*n*. That is, by reverse drive of the gas spring 22*a*, the piston rod 22*b* is moved in the cylinder 22*c*, so that the chair back bottom support member 14*a* is pivoted about the first bending portion 14*j* between the chair back bottom support member 14*a* and the chair waist bottom member 15*b* from the seating posture to the flat posture. In accordance with the pivoting action, the back side arm member 35*a* is pivoted anticlockwise about the chair first bending portion 14*j*, the rear end of the chair leg first bottom support member 14*d* is pivoted anticlockwise relative to the front end thereof via the gas spring 22*a* so as to bring up the chair leg first bottom support member 14*d*, and the chair leg first bottom support member 14*d* is brought into a flat state substantially along the horizontal direction.

The footrest conjunction link 23 is a link for coupling the chair knee bottom support member 14*c* and the chair leg second bottom support member 14*e* and moving the chair knee bottom support member 14*c* and the chair leg second bottom support member 14*e* in such a manner that the axial direction of the chair knee bottom support member 14*c* and the axial direction of the chair leg second bottom support member 14*e* are parallel.

Hereinafter, further description will be given. The footrest conjunction link 23 is composed of coupling a vicinity part of the chair third bending portion 14*m* of the chair knee bottom support member 14*c* and a vicinity part of the chair leg second bottom support member 14*e* to each other by a rod shaped member. Length of the footrest conjunction link 23 is substantially the same as the length of the chair first leg support member 14*d*. Thus, in FIG. 4, when the chair back bottom support member 14*a* is changed from the flat posture to the seating posture, the front end edge of the chair knee bottom support member 14*c* stands up relative to the rear end edge thereof via the first link portion 21, and accordingly, a front end edge of the chair leg second bottom support member 14*e* also stands up relative to a rear end edge thereof. As a result, the axial direction of the chair knee bottom support member 14*c* and the axial direction of the chair leg second bottom support member 14*e* are parallel.

Meanwhile, in FIG. 3A, when the chair back bottom support member 14*a* is changed from the seating posture to the flat posture, the chair knee bottom support member 14*c* is brought down, so that the rear end edge and the front end edge are brought into a flat state along a horizontal surface. At the same time, the rear end edge and the front end edge of the chair leg second bottom support member 14*e* are brought into a flat state along a horizontal surface.

With such a configuration of the wheelchair 9, in conjunction with inclination of the chair back bottom support member 14*a*, the chair knee bottom support member 14*c*, the chair leg first bottom support member 14*d*, and the chair second leg support member 14*e* are moved. Therefore, only by changing the inclination of the chair back bottom support member 14*a*, inclinations of the other support members are changed in conjunction therewith. Thus, only by bringing down the chair back bottom support member 14*a* from a lifted state, the wheelchair 9 is changed from the seating posture to the flat posture. Only by lifting the chair back bottom support member 14*a*, the wheelchair 9 is changed from the flat posture to the seating posture. Therefore, the caregiver can easily manually change the posture of the wheelchair 9.

In the wheelchair 9 as a single body, the chair waist bottom member 15*b* is a horizontal surface and the chair knee bottom member 15*c* is inclined relative to the chair waist bottom member 15*b* in the seating posture. Specifically, the chair knee bottom member 15*c* is inclined in such a manner that a front end edge of the chair knee bottom member 15*c* is positioned vertically upward relative to a rear end edge thereof so as to make an angle of 10° to 17°. Therefore, a depression is made by the chair back bottom member 15*a*, the chair waist bottom member 15*b*, and the chair knee bottom member 15*c* so as to prevent the downward slippage of the body of the care-receiver.

The bed main body portion 10 has a bed bottom portion 17, a bed bottom support member (bed bottom guide member) 18 supporting the bed bottom portion 17, and a bed base portion 19 fixing the bed bottom support member 18. It should be noted that as described above, the bed bottom portion 17 and the bed bottom support member 18 are integrated in the present embodiment.

The bed bottom portion 17 is composed of bendably coupling a plurality of plate shaped bed bottom members (such as four bed bottom members serving as a bed back bottom member 17*a*, a bed waist bottom member 17*b*, a bed knee bottom member 17*c*, and a bed leg bottom member 17*d*) at coupling parts, which bottom members serve as parts to be respectively brought into contact with the body of the care-receiver. That is, the bed bottom portion 17 is composed of the four bed bottom members 17*a*, 17*b*, 17*c*, 17*d*. Among these members, the adjacent members are bendably coupled to each other at three points via the coupling parts of thin parts or hinge parts (joint portions 20*a*, 20*c*, 20*e* described later). The coupling parts of the thin parts may be composed of parts each having a thickness thinner than a thickness of each of the bed back bottom member 17*a* to the bed leg bottom member 17*d* mainly composing the bed bottom portion 17, and thereby the coupling parts are bendable. The bed back bottom member 17*a* is a part to be brought into contact with the back of the care-receiver. The bed waist bottom member 17*b* is a part to be brought into contact with the waist of the care-receiver. The bed knee bottom member 17*c* is a part to be brought into contact with the thighs of the care-receiver. The bed leg bottom member 17*d* is a part to be brought into contact with the legs and the heels of the care-receiver. The bed back bottom member 17*a*, the bed waist bottom member 17*b*, the bed knee bottom member 17*c*, and the bed leg bottom member 17*d* generally have a cushion function.

The bed bottom support member 18 is composed of a plurality of bed bottom support members 18*a*, 18*c*, 18*d* and bed first to third bending portions 18*j*, 18*k*, 18*m*.

The plurality of bed support members 18*a*, 18*c*, 18*d* are bendably coupled to one another via the bed bending portions 18*j*, 18*k*, 18*m* composed of free rotation joints so as to compose a bed posture change mechanism 119. By the bed posture change mechanism 119, a posture of the bed bottom portion 17 is changed.

It should be noted that in the present embodiment, the bed back bottom member 17*a* and the bed back bottom support member 18*a* serve as one integrated member. Similarly, in the present embodiment, the bed knee bottom member 17*c* and the bed knee bottom support member 18*c* serve as one integrated member. Similarly, in the present embodiment, the bed leg bottom member 17*d* and the bed leg bottom support member 18*d* serve as one integrated member.

Figure 7A:
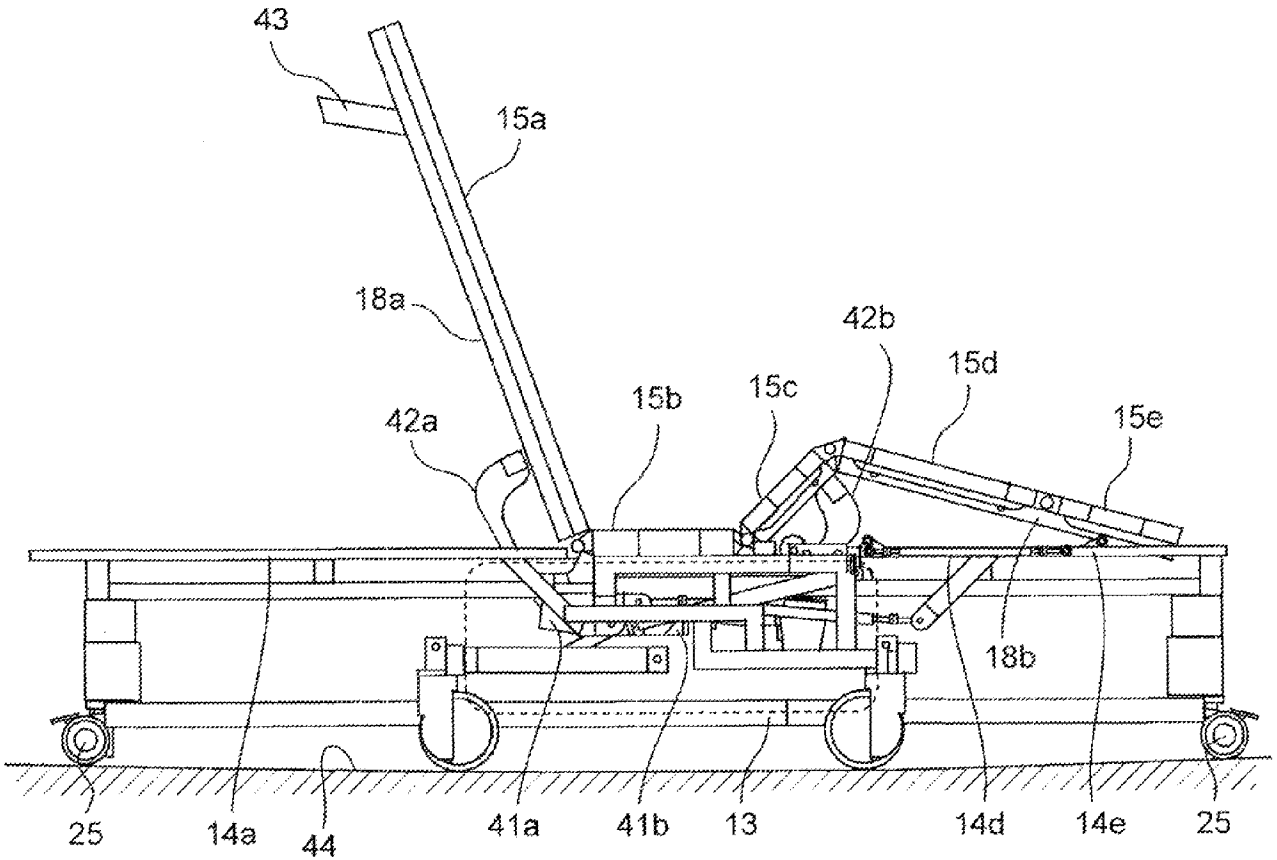
FIG. 7A is a side view of the bed in the knee lifting posture and the back lifting posture in the present embodiment.
Figure 7B:
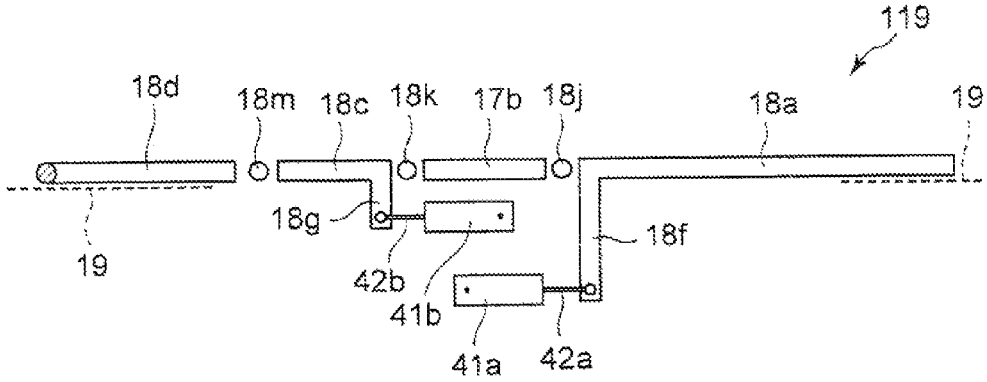
FIG. 7B is a schematic side view of a link mechanism of a bed main body portion in the present embodiment in a flat posture state.
Figure 7C:
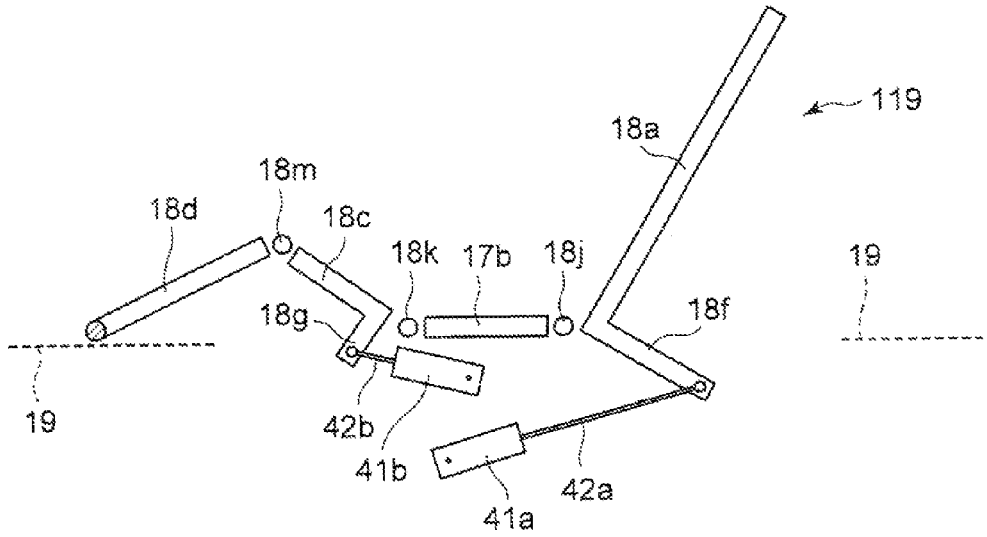
FIG. 7C is a schematic side view of the link mechanism of the bed main body portion in the present embodiment in a seating posture state.
Figure 8:
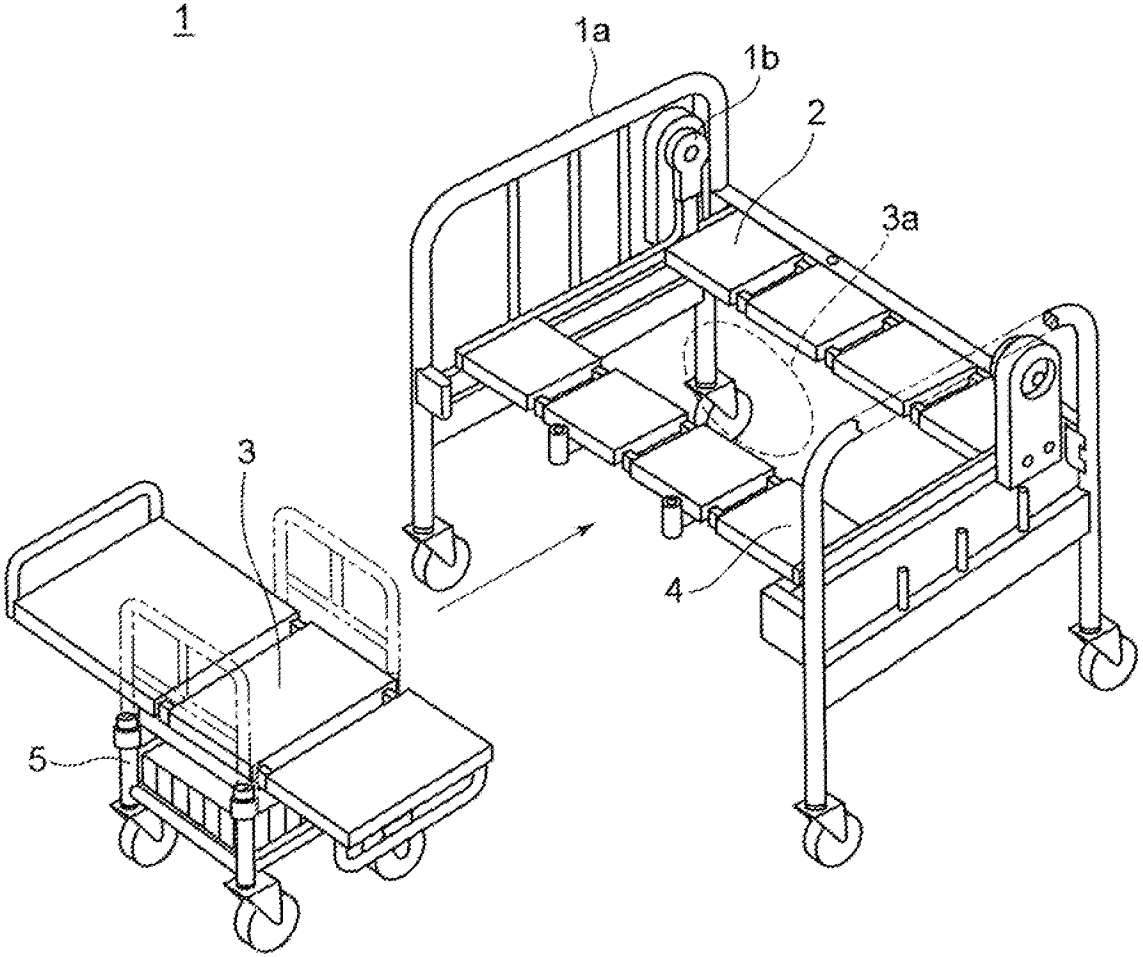
FIG. 8 is a perspective view of a conventional bed in which a part thereof is a wheelchair.
Figure 9:
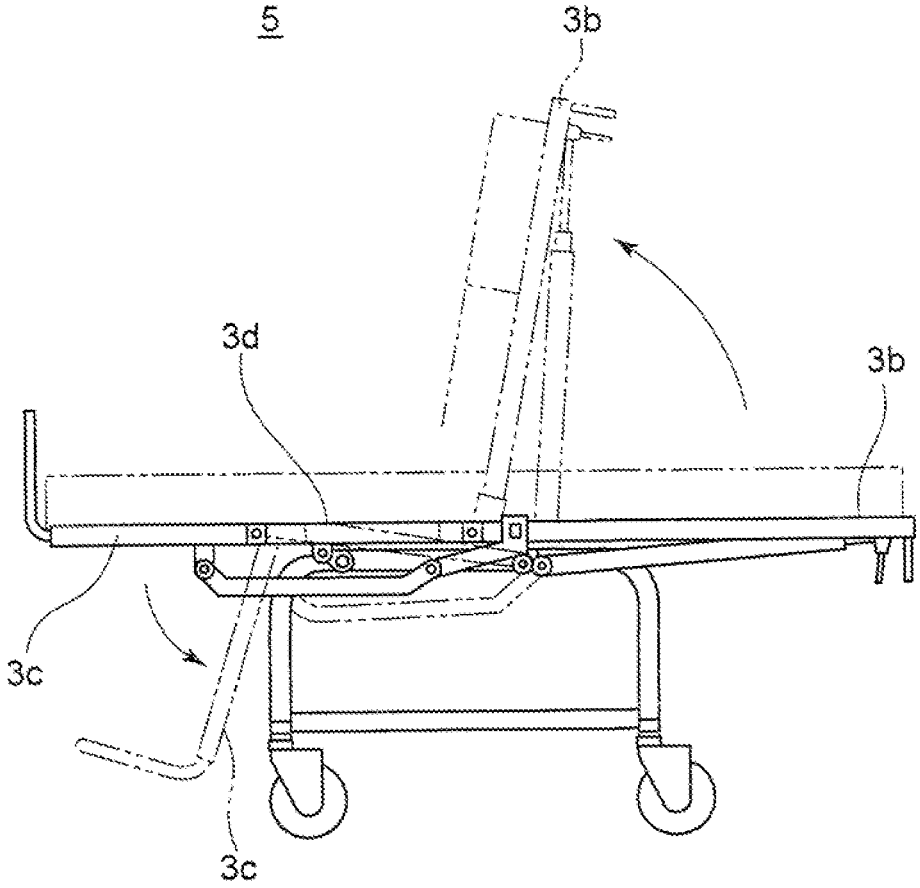
FIG. 9 is a side view of the wheelchair to be combined with the conventional bed.
Figure 10:
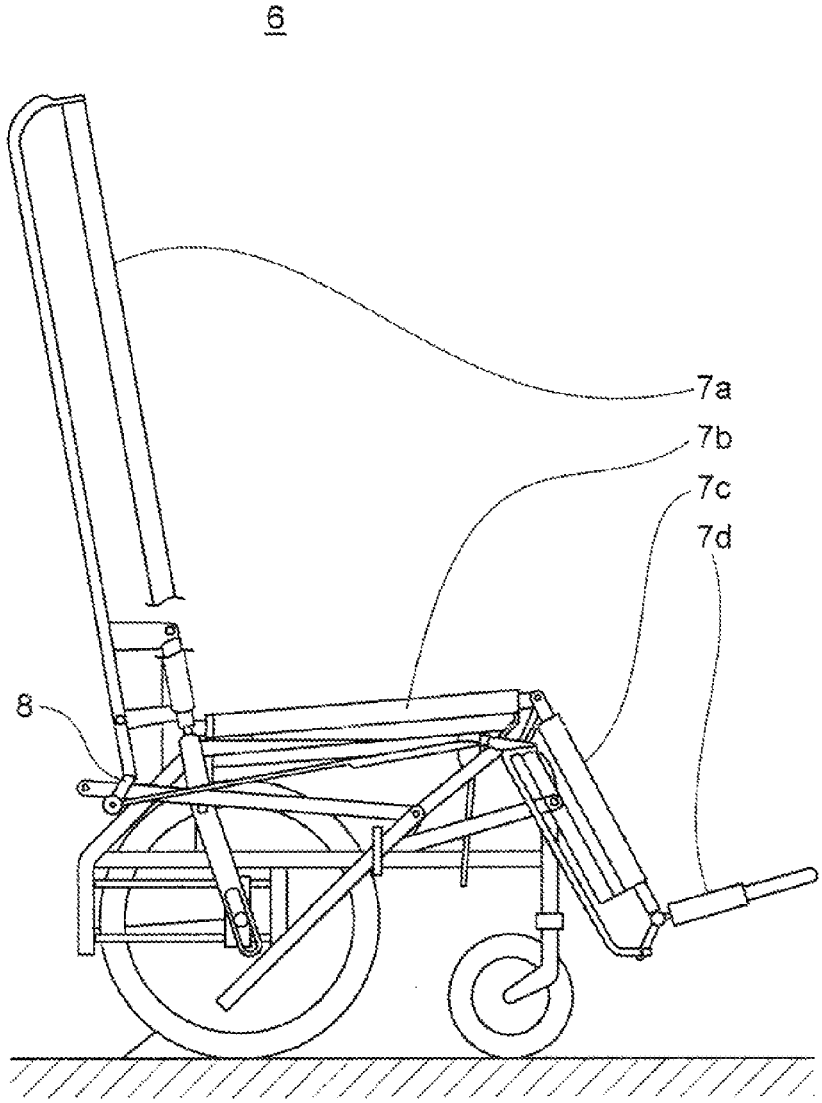
FIG. 10 is a side view of the conventional wheelchair in the seating posture.
Figure 11:
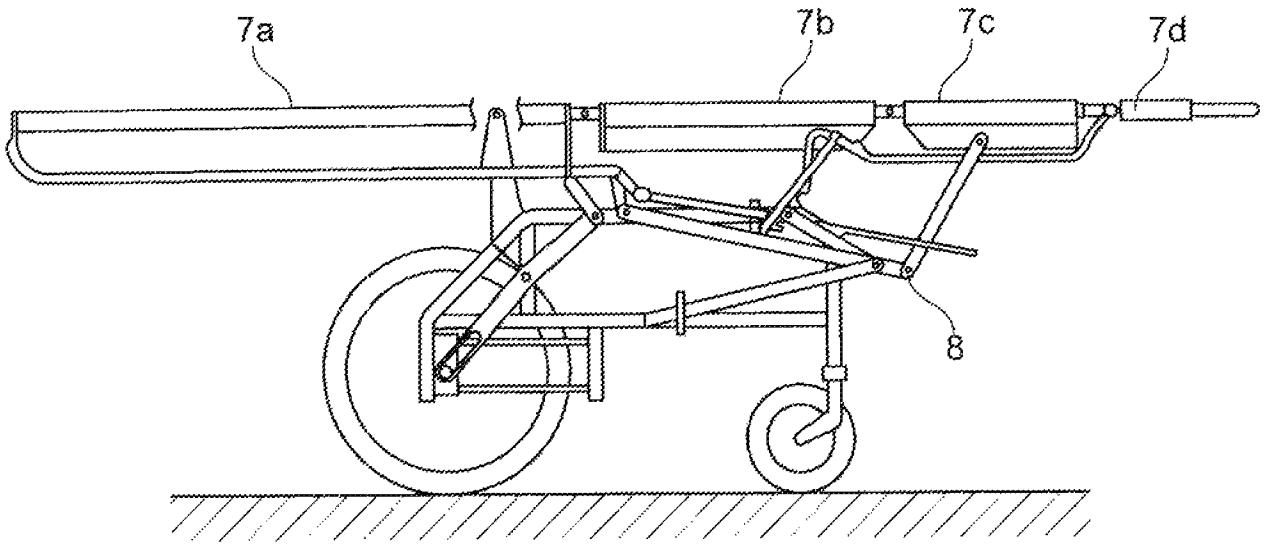
FIG. 11 is a side view of the conventional wheelchair in the flat posture.

Specifically, as shown in FIGS. 1, 7B, and 7C, the bed bottom support member 18 is composed of the bed back bottom support member 18*a* composed into a ladder shape in which a large number of crosspieces are fixed in the width direction between a pair of support rod members in the longitudinal direction. The bed knee bottom support member 18*c* is composed into a similar ladder shape to the bed back bottom support member 18*a*, the bed leg bottom support member 18*d* is composed into a similar ladder shape to the bed back bottom support member 18*a*, and the three bed first to third bending portions 18*j*, 18*k*, 18*m* bendably couple the adjacent support members to one another.

The bed back bottom support member 18*a* always supports the bed back bottom member 17*a*, and a protruding portion 118 protruding in the width direction from the bed back bottom member 17*a* is capable of supporting the chair back bottom member 15*a*. The bed knee bottom support member 18*c* always supports the bed knee bottom member 17*c*, and a protruding portion 118 protruding in the width direction from the bed knee bottom member 17*c* is capable of supporting the chair knee bottom member 15*c*. The bed leg bottom support member 18*d* always supports the bed leg bottom member 17*d*, and a protruding portion 118 protruding in the width direction from the bed leg bottom member 17*d* is capable of supporting the chair leg first bottom member 15*d* and the chair leg second bottom member 15*e*.

In such a way, the bed back bottom support member 18*a*, the bed knee bottom support member 18*c*, and the bed leg bottom support member 18*d* respectively form the protruding portions 118 respectively exposed to protrude on one side in the width direction from the bed back bottom member 17*a*, the bed knee bottom member 17*c*, and the bed leg bottom member 17*d*. These protruding portions 118 are capable of supporting the chair back bottom member 15*a*, the chair knee bottom member 15*c*, the chair leg first bottom member 15*d*, and the chair leg second bottom member 15*e* of the wheelchair 9 after the wheelchair 9 is combined with the bed main body portion 10.

Since the bed waist bottom member 17*b*, the bed back bottom support member 18*a*, and the bed knee bottom support member 18*c* are coupled to one another, position displacement is not generated between the bed bottom member 17 and the bed bottom support member 18.

On one of left and right sides in the width direction of the bed bottom portion 17 (for example, on the left side in FIG. 1), a recess portion 28 is composed between the bed back bottom support member 18*a* and the bed knee bottom support member 18*c*. The recess portion 28 is a combination area serving as a space into which the chair base portion 13 is inserted and composed between the bed back bottom support member 18*a* and the bed knee bottom support member 18*c*. The chair base portion 13 of the wheelchair 9 is insertable into the recess portion 28 as the combination area.

It should be noted that the seating bottom portion 15 has the five chair bottom members 15*a*, 15*b*, 15*c*, 15*d*, 15*e* and is bent at four points. Meanwhile, the bed bottom portion 17 has the four bed bottom members 17*a*, 17*b*, 17*c*, 17*d* and is bent at three points. That is, a division structure is different between the bed bottom portion 17 and the seating bottom portion 15. However, the three bed bottom members 17*a*, 17*b*, 17*c* of the bed bottom portion 17 respectively correspond to the three chair bottom members 15*a*, 15*b*, 15*c* of the seating bottom portion 15, and the remaining one bed bottom member 17*d* of the bed bottom portion 17 corresponds to the remaining two chair bottom members 15*d*, 15*e* of the seating bottom portion 15.

The bed base portion 19 supports the bed waist bottom member 17*b* to which the bed bottom support member 18 is coupled while allowing a bending action of this bed bottom support member 18. A part corresponding to the recess portion 28 serving as an intermediate part of the bed base portion 19 and as the combination area is recessed in the width direction, so that the chair base portion 13 of the wheelchair 9 is insertable.

In the present embodiment, four traveling wheels 25 are provided for the bed. The four traveling wheels 25 are respectively rotatably provided on the front and rear sides of a lower part of the bed base portion 19, and moveably support the bed base portion 19. The traveling wheels 25 are capable of traveling on the ground (or the installment surface of the wheelchair 9 and the bed main body portion 10) 44. However, in the case where there is no need for moving the bed main body portion 10, the traveling wheels 25 are not necessarily provided.

In the present embodiment, the bed bottom members 17*a*, 17*b*, 17*c*, 17*d* composing the bed bottom portion 17 of the bed main body portion 10 are freely bent at the coupling parts. Thus, the bed bottom portion 17 cannot maintain a fixed shape. Therefore, the bed bottom portion 17 performs the posture maintenance or the posture change integrally with a posture of the bed bottom support member 18.

By changing such a wheelchair 9 from the seating posture to the flat posture and combining the wheelchair 9 in the flat posture with the bed main body portion 10, the bed 11 is composed. In order to combine the wheelchair 9 and the bed main body portion 10, firstly, the wheelchair 9 is changed to the flat posture. The chair base portion 13 is moved to the combination area serving as the recess portion 28 of the bed bottom support member 18, that is, the wheelchair 9 is moved in the width direction, and the chair base portion is positioned in the recess portion 28 provided on the side of the bed waist bottom member 17*b* between the bed back bottom support member 18*a* and the bed knee bottom support member 18*c*. Since the chair base portion 13 of the wheelchair 9 in the flat posture comes into the recess portion 28, the wheelchair 9 is positioned relative to the bed main body portion 10. After that, the seating bottom portion 15 is supported by the bed bottom support member 18, so that combination of the wheelchair 9 and the bed main body portion 10 is completed. In the case where the wheelchair 9 and the bed main body portion 10 are combined in such a way, a member supporting the seating bottom portion 15 is switched from the chair support member to the bed bottom support member 18 (that is, the seating bottom portion 15 is supported only by the bed bottom support member 18 instead of the chair support member 14). In the bed 11 of the present invention, by switching the support member supporting the seating bottom portion 15, when the posture change is performed by the bed bottom support member 18, the bed bottom portion 17 and the seating bottom portion 15 integrally perform the posture change.

Figure 2:
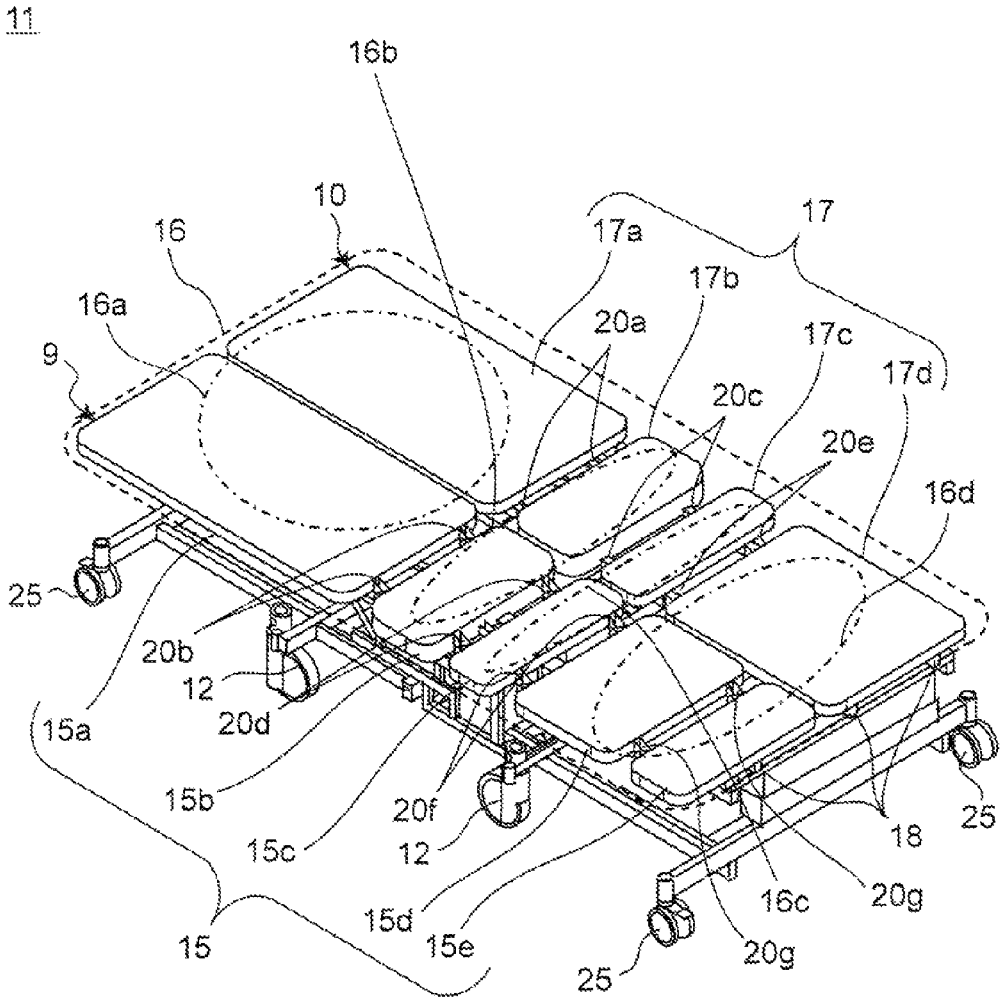
FIG. 2 is a perspective view of the combined bed in the present embodiment.

FIG. 2 is a perspective view of the combined bed 11 in the present embodiment. When the wheelchair 9 is combined with the bed main body portion 10, in the bed 11, the seating bottom portion 15 and the bed bottom portion 17 are integrated so as to compose a bed bottom portion 16. In the bed bottom portion 16, the chair back bottom member 15*a* and the bed back bottom member 17*a* serve as a back block 16*a*, the chair waist bottom member 15*b* and the bed waist bottom member 17*b* serve as a waist block 16*b*, the chair knee bottom member 15*c* and the bed knee bottom member 17*c* serve as a knee block 16*c*, the chair leg first bottom member 15*d*, the chair leg second bottom member 15*e*, and the bed leg bottom member 17*d* serve as a leg block 16*d*, and the adjacent blocks are bendable to each other.

In the bed bottom portion 16, the joint portions 20*a* of the bed back bottom member 17*a* and the bed waist bottom member 17*b* and the joint portions 20*b* of the chair back bottom member 15*a* and the chair waist bottom member 15*b* are arranged on an identical straight line, the joint portions 20*c* of the bed waist bottom member 17*b* and the bed knee bottom member 17*c* and the joint portions 20*d* of the chair waist bottom member 15*b* and the chair knee bottom member 15*c* are arranged on an identical straight line, and the joint portions 20*e* of the bed knee bottom member 17*c* and the bed leg bottom member 17*d* and the joint portions 20*f* of the chair knee bottom member 15*c* and the chair leg first bottom member 15*d* are arranged on an identical straight line in such a manner that the adjacent blocks are bendable when the wheelchair 9 is combined with the bed main body portion 10.

With such a configuration, even in the bed bottom portion 16 composed of the seating bottom portion 15 and the bed bottom portion 17, portions between the blocks are bendable to each other. With such a configuration, in the present embodiment, even the bed 11 composed of the wheelchair 9 and the bed main body portion 10 can be changed to a knee lifting posture.

It should be noted that the knee lifting posture is a posture in which buttocks of the care-receiver are supported by a horizontal surface (the chair waist bottom member 15*b* or the bed waist bottom member 17*b*, or both), and thighs and calves are supported by an inclined surface (the chair knee bottom member 15*c* and the chair leg first bottom member 15*d*, or the bed knee bottom member 17*c* and the bed leg bottom member 17*d*, or all these members). The knee lifting posture indicates a posture in which a hip joint, a knee joint, and a toe of the care-receiver form a triangle.

It should be noted that in the longitudinal direction of the bed bottom portion 16, the length of the chair back bottom member 15*a* and length of the bed back bottom member 17*a* are equal, the length of the chair waist bottom member 15*b* and length of the bed waist bottom member 17*b* are equal, length of the chair knee bottom member 15*c* and length of the bed knee bottom member 17*c* are equal, and total length of the chair leg first bottom member 15*d* and the chair leg second bottom member 15*e* is equal to length of the bed leg bottom member 17*d*.

With such a configuration, in the case where the wheelchair 9 is combined with the bed main body portion 10, the posture change of the seating bottom portion 15 can be separated from the chair back bottom support member 14*a* and the like, and the posture change of the bed bottom portion 17 and the seating bottom portion 15 can be performed only by the bed bottom support member 18.

It should be noted that in the separated wheelchair 9 as a single body, the seating bottom portion is also supported by the chair back bottom support member 14*a*, the chair knee bottom support member 14*c*, the chair leg first bottom support member 14*d*, and the chair leg second bottom support member 14*e*.

However, the chair back bottom support member 14*a* is brought into contact with the chair back bottom member 15*a* so as to support the chair back bottom member, and the chair knee bottom support member 14*c* is brought into contact with the chair knee bottom member 15*c* so as to support the chair knee bottom member. The chair leg first bottom support member 14*d* is brought into contact with the chair leg first bottom member 15*d* so as to support the chair leg first bottom member, and the chair leg second bottom support member 14*e* is brought into contact with the chair leg second bottom member 15*e* so as to support the chair leg second bottom member.

The wheelchair 9 and the bed main body portion 10 are combined so as to compose the bed 11. Thus, when the bed bottom support member 18 brings up the seating bottom portion 15, the seating bottom portion 15 is separated to the chair back bottom support member 14*a*, the chair knee bottom support member 14*c*, the chair leg first bottom support member 14*d*, and the chair second support member 14*e*, and respectively supported by the bed bottom support member 18.

Figure 6:
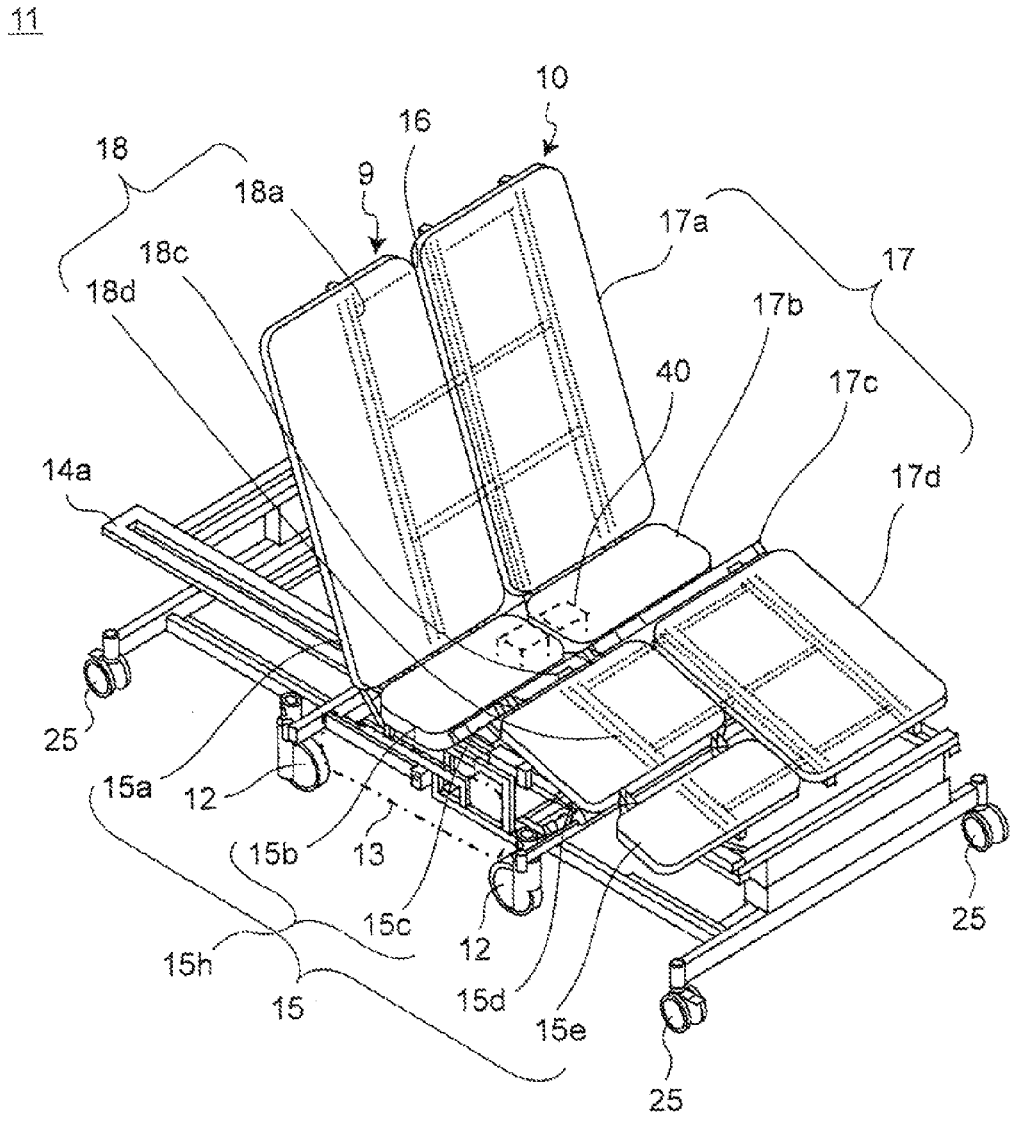
FIG. 6 is a perspective view of the bed in a knee lifting posture and a back lifting posture in the present embodiment.

As shown in FIGS. 6 and 7A, by lifting the bed back bottom support member 18*a* serving as a part of the bed bottom support member 18 and lifting the bed leg bottom support member 18*d* serving as a part of the bed bottom support member 18 so as to bend the bed bottom support member 18 into a "V" shape, the posture can be changed to a back lifting posture and a knee lifting posture as well as a general nursing care bed. At this time, the chair base portion 13 and the bed base portion 19 are coupled by a locking portion 40 so as not to be displaced. The locking portion 40 is to couple and fix the chair base portion 13 and the bed base portion 19 with a locking member (not shown) or cancel the coupling by manually pivoting a coupling lever (not shown) between a lock position and a lock cancellation position. The locking portion 40 is provided in the bed base portion 19. When the chair base portion 13 and the bed base portion 19 are coupled and fixed by the locking portion 40, the seating bottom portion 15 and the bed bottom portion 17 can be integrated so as to compose the bed bottom portion 16. When the coupling and fixing of the seating bottom portion 15 and the bed bottom portion 17 are cancelled, the seating bottom portion 15 and the bed bottom portion 17 can be easily separated.

In order to independently perform the posture change between the back lifting posture and the knee lifting posture in the bed bottom portion 16, in the bed bottom support member 18, the chair back bottom member 15*a* and the bed back bottom member 17*a* are supported by the bed back bottom support member 18*a*, and the chair knee bottom member 15*c* and the bed knee bottom member 17*c* are supported by the bed knee bottom support member 18*c*. The chair leg first bottom member 15*d*, the chair leg second bottom member 15*e*, and the bed leg bottom member 17*d* are supported by the bed leg bottom support member 18*d*.

A first electric drive portion 41*a* capable of changing inclination of the bed back bottom support member 18*a*, the bed knee bottom support member 18*c*, the bed leg bottom support member 18*d*, and the like, and a second electric drive portion 41*b* capable of changing postures of the bed knee bottom support member 18*c*, the bed leg bottom support member 18*d*, and the like are provided on the bed base portion 19 of the bed main body portion 10. By the first electric drive portion 41*a* and the second electric drive portion 41*b*, a back lifting action and a knee lifting action are independently performed with the bed bottom portion 16 composed of integrating the seating bottom portion 15 and the bed bottom portion 17 (refer to FIGS. 7A to 7C).

The first electric drive portion 41*a* lifts or brings down the bed back bottom support member 18*a* via an arm 42*a*. The second electric drive portion 41*b* lifts or brings down the bed knee bottom support member 18*c* and the bed leg bottom support member 18*d* via an arm 42*b* so as to bend the members into a "V" shape and make the members a flat surface.

The arm 42*a* of a back lifting translation actuator 41*a* serving as one example of the first electric drive portion 41*a* is in contact with a back surface on the base end side of the bed back bottom support member 18*a* so as to lift or bring down the bed back bottom support member 18*a* via the arm 42*a*. Therefore, by driving the back lifting translation actuator 41*a* so as to make the piston rod 42*a* travel back and forth, the bed back bottom support member 18*a* can be pivoted between the seating posture and the flat posture about the bed first bending portion 18*j* between the bed back bottom support member 18*a* and the bed waist bottom member 17*b*.

The arm 42*b* of a knee lifting translation actuator 41*b* serving as one example of the second electric drive portion is in contact with a back surface on the front end side of the bed knee bottom support member 18*c* so as to lift or bring down the bed knee bottom support member 18*c* via the arm 42*b*, so that the bed knee bottom support member 18*c* and the bed leg bottom support member 18*d* are bent into an inverted V shape or made to be a flat surface. Therefore, by driving the knee lifting translation actuator 41*b* so as to extend the piston rod 42*b*, the bed knee bottom support member 18*c* is pivoted clockwise about the bed second bending portion 18*k* relative to the bed waist bottom member 17*b*, and at the same time, the bed leg bottom support member 18*d* is pivoted anticlockwise about the bed third bending portion 18*m*. Thus, as shown in FIG. 7A, the bed main body portion 10 can be changed from the flat posture to the back lifting posture and the knee lifting posture. Conversely, by driving the knee lifting translation actuator 41*b* so as to contract the piston rod 42*a*, the bed knee bottom support member 18*c* is pivoted anticlockwise about the bed second bending portion 18*k* relative to the bed waist bottom member 17*b*, and at the same time, the bed leg bottom support member 18*d* is pivoted clockwise about the bed third bending portion 18*m*. Therefore, as shown in FIG. 4, the bed main body portion 10 can be changed from the back lifting posture and the knee lifting posture to the flat posture.

With such a configuration, in the case where electric drive control is performed with the bed 11, there is no need for providing electric drive portions with the wheelchair 9. Therefore, the wheelchair 9 can be simplified and the weight thereof can be reduced.

It should be noted that by appropriately combining arbitrary embodiments or modification examples among the above various embodiments or modification examples, effects provided in the embodiments and the modification examples can be obtained.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The bed of the present invention is a bed in which a part thereof can be separated as a wheelchair. Thus, the labor of a caregiver can be reduced upon a moving task of the care-receiver. While being the bed in which a part thereof can be separated as the wheelchair, the bed of the present invention also serves as a bed capable of being in a knee lifting posture. Such a bed is useful in an ordinary house, a hospital facility, or a nursing care facility where a person in need of care resides.

The invention claimed is:

1. A bed arrangement, comprising:

a wheelchair comprising:

a seating bottom portion composed of a chair back bottom member, a chair waist bottom member, a chair knee bottom member, a chair leg first bottom member and a chair leg second bottom member bendably coupled to each other; and a chair back bottom support member supporting said chair back bottom member, a chair base portion supporting said chair waist bottom member, a chair knee bottom support member supporting said chair knee bottom member, a chair leg first bottom support member supporting said chair leg first bottom member and a chair leg second bottom support member supporting said chair leg second bottom member;

a bed main body portion comprising:

a bed bottom portion composed of a bed back bottom member, a bed waist bottom member, a bed knee bottom member and a bed leg bottom member bendably coupled to each other; and a bed back bottom support member supporting said bed back bottom member, a bed base portion supporting said bed waist bottom member, a bed knee bottom support member supporting said bed knee bottom member, and a bed leg bottom support member supporting said bed leg bottom member;

wherein said wheelchair and said bed main body are combinable into a combined state in which:

in a longitudinal direction of said bed bottom, a length of said chair waist bottom member and a length of said bed waist bottom member are equal, a length of said chair knee bottom member and a length of said bed knee bottom member are equal, and a total length of said chair leg first bottom member and said chair leg second bottom member is equal to a length of said bed leg bottom member, a joint portion between said bed back bottom member and said bed waist bottom member and a joint portion between said chair back bottom member and said chair waist bottom member are arranged on an identical straight line, a joint portion between said bed waist bottom member and said bed knee bottom member and a joint portion between said chair waist bottom member and said chair knee bottom member are arranged on an identical straight line, a joint portion between said bed knee bottom member and said bed leg bottom member and a joint portion between said chair knee bottom member and said chair leg first bottom member are arranged on an identical straight line, and said wheelchair and said bed main body portion are capable of performing posture change together by bending at a said joint portion.

2. The bed arrangement according to claim 1, wherein, with respect to a care-receiver on said bed bottom, buttocks of the care-receiver are supported by at least one of said chair waist bottom member and said bed waist bottom member, and thighs and calves of the care-receiver are supported by at least one of said chair knee bottom member, said bed knee bottom member, said chair leg first bottom member, said chair leg second bottom member, and said bed leg bottom member, so as to form a knee lifting posture.

3. The bed arrangement according to claim 1, wherein, in said combined state:

said bed back support member is in contact with said chair back bottom member so as to support said chair back bottom member, said bed knee bottom support member is in contact with said chair knee bottom member so as to support said chair knee bottom member, and said bed leg bottom support member is in contact with said chair leg bottom support member so as to support said chair leg first bottom member and said chair leg second bottom member.

4. The bed arrangement according to claim 3, wherein, in a state in which said wheelchair and said bed main body portion are separated:

said chair back surface support member is in contact with said chair back bottom member so as to support said chair back bottom member, said chair knee surface support member is in contact with said chair knee bottom member so as to support said chair knee bottom member, and said chair leg surface support member is in contact with said chair leg first bottom member and said chair leg second bottom member so as to support said chair leg first bottom member and said chair leg second bottom member.

5. The bed arrangement according to claim 1, wherein, in said combined state, said seating bottom portion of said wheelchair is arranged so as to be movable in conjunction with a bed bottom support member composed of said bed back bottom support member, said bed knee bottom support member and said bed leg bottom support member.

6. The bed arrangement according to claim 1, wherein said wheelchair comprises a link portion for moving at least one of said knee support member and said chair leg support member in conjunction with movement of said chair back bottom support member.

7. A bed arrangement, comprising:

a wheelchair comprising:

a seating bottom portion composed of a chair back bottom member, a chair waist bottom member, a chair knee bottom member, a chair leg first bottom member and a chair leg second bottom member bendably coupled to each other; and a chair back bottom support member supporting said chair back bottom member, a chair base portion supporting said chair waist bottom member, a chair knee bottom support member supporting said chair knee bottom member, a chair leg first bottom support member supporting said chair leg first bottom member and a chair leg second bottom support member supporting said chair leg second bottom member;

a bed main body portion comprising:

a bed bottom portion composed of a bed back bottom member, a bed waist bottom member, a bed knee bottom member and a bed leg bottom member bendably coupled to each other; and a bed back bottom support member supporting said bed back bottom member, a bed base portion supporting said bed waist bottom member, a bed knee bottom support member supporting said bed knee bottom member, and a bed leg bottom support member supporting said bed leg bottom member;

wherein said wheelchair comprises a link portion for moving at least one of said knee support member and said chair leg bottom support member in conjunction with movement of said chair back bottom support member, wherein said chair back bottom support member has an arm member extending downward from a coupling portion of said chair waist bottom member and said chair back bottom support member, wherein said link portion has a cam portion rotatably coupled to said chair waist bottom member, and a coupling member connecting a lower end of said cam portion and said arm member, wherein said upper end of said cam portion pushes up said chair leg bottom support member in a state where said chair back bottom support member is lifted and said coupling member pulls said lower end of cam portion in a direction of said chair back bottom support member, wherein said upper end of said cam portion pushes down said chair leg bottom support member in a state where said chair back bottom support member is lowered and said coupling member pushes said lower end of said cam portion in a direction of said chair leg bottom support member, and wherein said wheelchair and said bed main body portion are capable of performing posture change together in a combined state.

8. A wheelchair capable of being combined with a bed main body portion so as to form a bed capable of performing posture change, comprising:

a seating bottom portion composed of a chair back bottom member, a chair seating bottom member including a chair waist bottom member and a chair knee bottom member, a chair leg first bottom member, and a chair leg second bottom member bendably coupled to each other;

a chair base portion supporting the chair waist bottom member;

a chair back bottom support member bendable with respect to the chair waist bottom member, the chair back bottom support member supporting the chair back bottom member;

a chair knee bottom support member bendable with respect to the chair waist bottom member, the chair knee bottom support member supporting the chair knee bottom member;

a chair leg first bottom support member bendable with respect to the chair knee bottom support member, the chair leg first bottom support member supporting the chair leg first bottom member;

a chair leg second bottom support member bendable with respect to the chair leg first bottom support member, the chair leg second bottom support member supporting the chair leg second bottom member;

a first link portion that moves the chair knee bottom support member in conjunction with movement of the chair back bottom support member;

a second link portion that moves the chair leg first bottom support member in conjunction with the movement of the chair back bottom support member; and a footrest conjunction link that moves the chair leg second bottom support member in conjunction with movement of the chair knee bottom support member, wherein the first link portion couples the chair back bottom support member and the chair knee bottom support member to each other, wherein the chair knee bottom support member is lifted by the first link portion in conjunction with the movement of the chair back bottom support member when the chair back bottom support member is lifted from a lowered state relative to the chair waist bottom member, whereas the chair knee bottom support member is lowered by the first link portion in conjunction with the movement of the chair back bottom support member when the chair back bottom support member is lowered from a lifted state, wherein the second link portion couples the chair back bottom support member and the chair leg first bottom support member to each other, wherein the chair leg first bottom support member is suspended down by the second link portion in conjunction with the movement of the chair back bottom support member when the chair back bottom support member is lifted from the lowered state relative to the chair waist bottom member, whereas the suspended-down chair leg first bottom support member is brought up by the second link portion in conjunction with the movement of the chair back bottom support member when the chair back bottom support member is lowered from the lifted state, wherein the footrest conjunction link couples the chair knee bottom support member and the chair leg second bottom support member to each other, and wherein the chair knee bottom support member and the chair leg second bottom support member are moved so as to be parallel by the footrest conjunction link in conjunction with the movement of the chair knee bottom support member relative to the chair base portion.

* * * * *